United States Patent [19]

Hirano

[11] Patent Number: 4,574,747

[45] Date of Patent: Mar. 11, 1986

[54] COOLING SYSTEM FOR AUTOMOTIVE ENGINE

[75] Inventor: Yoshinori Hirano, Yokohama, Japan

[73] Assignee: Nissan Motor Co., Ltd., Yokohama, Japan

[21] Appl. No.: 676,937

[22] Filed: Nov. 30, 1984

[30] Foreign Application Priority Data

Dec. 2, 1983 [JP] Japan ..... 58-228146

[51] Int. Cl.[4] ..... F01P 33/00

[52] U.S. Cl. ..... 123/41.27; 123/41.54

[58] Field of Search ..... 123/41.2, 41.21, 41.22, 123/41.23, 41.24, 41.25, 41.26, 41.27, 41.51, 41.53, 41.54; 220/85 VR, 85 VS

[56] References Cited

U.S. PATENT DOCUMENTS

| | | | |
|---|---|---|---|
| 1,632,582 | 6/1927 | Barlow | 123/41.21 |
| 1,852,770 | 4/1932 | Duesenberg | 123/41.27 |
| 3,312,204 | 4/1967 | Barlow | 123/41.25 |
| 3,921,600 | 11/1975 | Henning et al. | 123/41.54 |
| 4,367,699 | 1/1983 | Evans | 123/41.23 |

*Primary Examiner*—William A. Cuchlinski, Jr.

*Attorney, Agent, or Firm*—Schwartz, Jeffery, Schwaab, Mack, Blumenthal & Evans

[57] ABSTRACT

In order to assure that the cooling system of a so called "vapor cooled" type engine remains free from contaminating air, a control system is provided which enables air to be purge both during initial engine warm-up and during normal operation if the temperature of the coolant rises excessively. The control system further provides for the temperature of the coolant to be varied with factors such as engine speed and engine load and further provides that, before the system is switch to an "open state" when the engine is stopped, the coolant temperature is caused to rapidly fall via continued operation of a cooling fan or like device for a brief time, so as to eliminate any super atmospheric pressures which would otherwise tend to displace large quantities of the coolant out of the system.

6 Claims, 16 Drawing Figures

EXCESS COOLANT DISPLACEMENT ROUTINE

OVERCOOL CONTROL ROUTINE

SHUT-DOWN ROUTINE

COOLING SYSTEM FOR AUTOMOTIVE ENGINE

BACKGROUND OF THE INVENTION

1. Field of the Invention

The present invention relates generally to a cooling system for an internal combustion engine wherein liquid coolant is boiled to make use of the latent heat of vaporization of the same and the vapor used as a vehicle for removing heat from the engine, and more specifically to such a system which includes a control system which enables simple precise control of the operation of same and which includes means for minimizing the time for which the coolant boils after engine shut-down (due to thermal inertia) so as to permit the system to be quickly converted to an open state without large quantities of coolant being displaced out into an external reservoir by super atmospheric pressures within the cooling system.

2. Description of the Prior Art

In currently used "water cooled" internal combustion engines such as shown in FIG. 1 of the drawings, the engine coolant (liquid) is forcefully circulated by a water pump, through a circuit including the engine coolant jacket and an air cooled radiator. This type of system encounters the drawback that a large volume of water is required to be circulated between the radiator and the coolant jacket in order to remove the required amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having 1800 cc displacement (by way of example) is operated at full throttle, the cooling system is required to remove approximately 4000 Kcal/h. In order to acheive this a flow rate of 167 Liter/min (viz., $4000-60\times\frac{1}{4}$) must be produced by the water pump. This of course undesirably consumes a number of otherwise useful horsepower.

FIG. 2 shows an arrangement disclosed in Japanese Patent Application Second Provisional Publication No. Sho 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity.

This arrangement has suffered from the drawbacks that the radiator, depending on its position with respect to the engine proper tends to be at least partially filled with liquid coolant. This greatly reduces the surface area via which the gaseous coolant (for example steam) can effectively release its latent heat of vaporization and accordingly condense and thus has lacked any notable improvement in cooling efficiency.

Further, with this system in order to maintain the pressure within the coolant jacket and radiator at atmospheric level, a gas permeable water shedding filter 5 is arranged as shown, to permit the entry of air into and out of the system. However, this filter permits gaseous coolant to gradually escape from the system, inducing the need for frequent topping up of the coolant level.

A further problem with this arrangement has come in that some of the air, which is sucked into the cooling system as the engine cools, tends to dissolve in the water, whereby upon start up of the engine, the dissolved air tends to form small bubbles in the radiator which adhere to the walls thereof forming an insulating layer. The undisolved air tends to collect in the upper section of the radiator and inhibit the convention-like circulation of the vapor from the cylinder block to the radiator. This of course further deteriorates the performance of the device.

European Patent Application Provisional Publication No. 0 059 423 published on Sept. 8, 1982 discloses another arrangement wherein, liquid coolant in the coolant jacket of the engine, is not circulated therein and permitted to absorb heat to the point of boiling. The gaseous coolant thus generated is adiabatically compressed in a compressor so as to raise the temperature and pressure thereof and introduced into a heat exchanger. After condensing, the coolant is temporarily stored in a reservoir and recycled back into the coolant jacket via a flow control valve.

This arrangement has suffered from the drawback in that air tends to leak into the system upon cooling thereof. This air tends to be forced by the compressor along with the gaseous coolant into the radiator. Due to the difference in specific gravity, the air tends to rise in the hot environment while the coolant which has condensed moves downwardly. The air, due to this inherent tendency to rise, forms large bubbles of air which cause a kind of "embolism" in the radiator and badly impair the heat exchange ability thereof.

U.S. Pat. No. 4,367,699 issued on Jan. 11, 1983 in the name of Evans (see FIG. 3 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the "dry" gaseous coolant (steam for example) is condensed in a fan cooled radiator 8. The temperature of the radiator is controlled by selective energizations of the fan 9 to maintain a rate of condensation therein sufficient to maintain a liquid seal at the bottom of the device. Condensate discharged from the radiator via the above mentioned liquid seal is collected in a small reservoir-like arrangement 10 and pumped back up to the separation tank via a small pump 11.

This arrangement, while providing an arrangement via which air can be initially purged from the system tends to, due to the nature of the arrangement which permits said initial non-condensible matter to be forced out of the system, suffers from rapid loss of coolant when operated at relatively high altitudes. Further, once the engine cools air is relatively freely admitted back into the system. The provision of the separation tank 6 also renders engine layout difficult.

Japanese Patent Application First Provisional Publication No. Sho. 56-32026 (see FIG. 4 of the drawings) discloses an arrangement wherein the structure defining the cylinder head and cylinder liners are covered in a porous layer of ceramic material 12 and coolant sprayed into the cylinder block from shower-like arrangements 13 located above the cylinder heads 14. The interior of the coolant jacket defined within the engine proper is essentially filled with gaseous coolant during engine operation during which liquid coolant sprayed onto the ceramic layers 12. However, this arrangement has proved totally unsatisfactory in that upon boiling of the liquid coolant absorbed into the ceramic layers the vapor thus produced escaping into the coolant jacket inhibits the penetration of liquid coolant into the layers whereby rapid overheat and thermal damage of the ceramic layers 12 and/or engine soon results. Further, this arrangement is plagued with air contamination and blockages in the radiator similar to the compressor equipped arrangement discussed above.

In summary although the basic concepts of open and closed "vapor cooling" systems wherein the coolant is boiled to make use of the latent heat of evaporation thereof and condensed in a suitable heat exchanger, is known, the lack of a control system which is both sufficiently simple as to allow practical use and which overcomes the various problems plauging the prior art is wanting.

SUMMARY OF THE INVENTION

It is an object of the present invention to provide a cooling system for an internal combustion engine of the "vapor cooled" type wherein adequate control can be executed over the operation of the system under all modes of operation including those during which excessively low internal pressures which tend to crush components of the system or induct excessive amounts of contaminating air into the system, are induced by uncontrollable external influences, (such as low ambient temperatures etc.,) and whereby any non-condensible matter which finds its way into the system can be readily removed.

A further object of the present invention is to provide a cooling system which features a control which enables the reduction in size of auxiliary devices such as a coolant reservoir.

Yet another object of the present invention is to provide a system of the nature indicated above wherein the boiling point of the engine coolant can be controlled in response to changes in engine speed and engine load.

In brief, the above objects are achieved by a vapor cooled engine arrangement wherein a control circuit including a microprocessor is arranged to selectively induce:

a non-condensible purge mode—wherein excess coolant is pumped into the cooling system to the point of overfilling same and thus displacing any air or like non-condensible matter;

an excess coolant displacement mode—wherein the coolant and engine are rapidly warmed due to the system being completely filled with liquid coolant (which inhibits heat exchange with the ambient atmosphere) and wherein the vapor produced by the heating used to displace excess coolant from the system until the amount required for normal operation remains;

a normal operation mode—wherein the temperature of the engine is controlled by controlling the rate of condensation of vapor (generated in the coolant jacket) in the radiator;

an overcooled control mode—wherein the radiator is partially filled with liquid coolant in order to reduce the effective heat exchange surface area thereof and thus prevent excessively low temperatures and pressures from prevailing within the system;

a high temperature (overheat) control mode—wherein in the event that air is trapped in the relatively small diameter conduits of the radiator, blocking same and inducing the situation wherein sufficient heat cannot be released to the ambient atmosphere, the system is "opened" in a manner that the relatively high pressure coolant vapor is vented from the system via the bottom of the radiator. This induces a sudden flow of coolant vapor from the top of the radiator to the bottom thereof. This sudden flow scavenges out any air and simultaneously returns the pressure in the system to atmospheric whereby the boiling point of the coolant is lowered; and a system shut-down mode—wherein the coolant temperature and pressure within the system are rapidly reduced to a level which eliminates any positive pressure which tends to displace overly large amounts of coolant out of the system to an externally disposed coolant reservoir, upon the system being switched from a closed state to an open one.

The latter mentioned mode allows the size of the reservoir to be minimized and therefore an overall reduction in the weight of the system.

More specifically, the present invention takes the form of a cooling system for an internal combustion engine which comprises: a coolant jacket formed about structure of the engine subject to high heat flux, the radiator being arranged to receive coolant in liquid form and discharge same in gaseous form; a radiator; a first conduit leading from the radiator for introducing liquid coolant from the radiator into the coolant jacket; a second conduit leading from the coolant jacket to the radiator through which gaseous coolant is transferred from the coolant jacket to the radiator for condensation therein; a coolant reservoir; a sensor responsive to one of the temperature and pressure within the coolant jacket; a third conduit leading from the radiator to the reservoir, the third conduit being arranged to communicate with the reservoir in a manner to define a vapor trap; a valve arrangement which controls the third conduit; and first means responsive to the sensor for operating the valve arrangement in a manner to open the third conduit when the sensor indicates an overheat condition of the system and permit gasesous coolant to vent through the third conduit to the reservoir, the gaseous coolant being released into the reservoir in a manner to bubble through liquid coolant stored therein.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Before proceeding with the description of the actual embodiment of the present invention, it is deemed advantageeous to firstly discuss the concepts on which the present invention is based.

Figure 6:
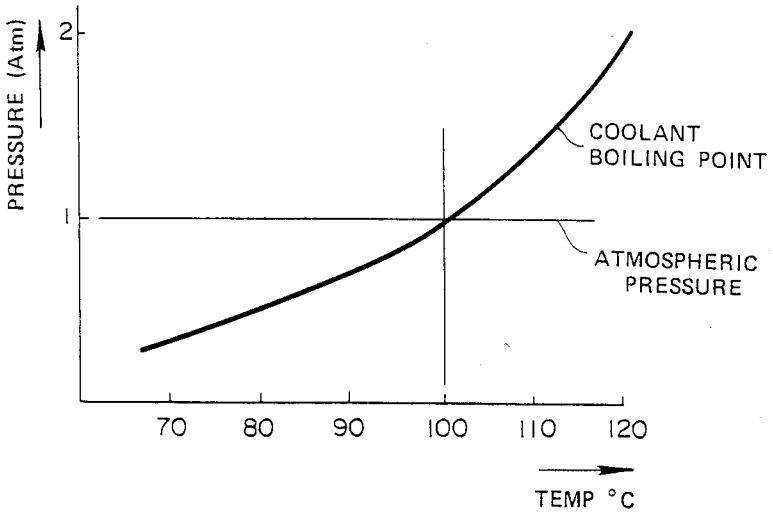
FIG. 6 is a graph showing in terms of pressure and temperature, the change which occurs in the coolant boiling point with change in pressure.

FIG. 6 graphically shows, in terms of engine torque and engine speed, the various load "zones" which are encountered by an automotive vehicle engine. In this graph, the the curve F denotes full throttle torque characteristics, trace L denotes the resistance encountered when a vehicle is running on a level surface, and zones I, II and III denote respectively what shall be referred to as "urban cruising", "high speed cruising" and "high load operation" (such as hillclimbing, towing etc.).

A suitable coolant temperature for zone I is approximately 110° C. while 100°–98° C. (for example) for zones II and III. The high temperature during "urban cruising" of course promotes improved fuel economy while the lower temperatures promote improved charging efficiency while simultaneously removing sufficient heat from the engine and associated structure to obviate engine knocking and/or engine damage in the other zones.

With the present invention, in order to control the temperature of the engine, advantage is taken of the fact that with a cooling system wherein the coolant is boiled and the vapor used a heat transfer medium, boiling is most vigorous in zones of high heat flux, whereby the temperature of engine structure subject to high heat flux is maintained essentially equal to that of structure subject to less intensive heating whereat boiling is less vigorous and less heat removed; the amount of coolant actually circulated between the coolant jacket and the radiator is very small; the amount of heat removed from the engine per unit volume of coolant is very high; and upon boiling, the pressure prevailing within the coolant jacket and consequently the boiling point of the coolant rises if the system employed is closed. Thus, by circulating a controlled amount of cooling air over the radiator, it is possible reduce the rate of condensation therein and cause the pressure within the cooling system to rise above atmospheric and thus induce the situation, as shown in FIG. 7, wherein the engine coolant boils at temperatures above 100° C.—for example at approximately 110° C.

On the other hand, during high speed cruising, it is further possible by increasing the flow of cooling air passing over the radiator (for example by energizing a cooling fan and/or by using the natural draft of air which occurs under such conditions) to increase the rate of condensation within the radiator to a level which reduces the pressure prevailing in the cooling system below atmospheric and thus induce the situation wherein the coolant boils at temperatures below 100° C.

Figure 7:
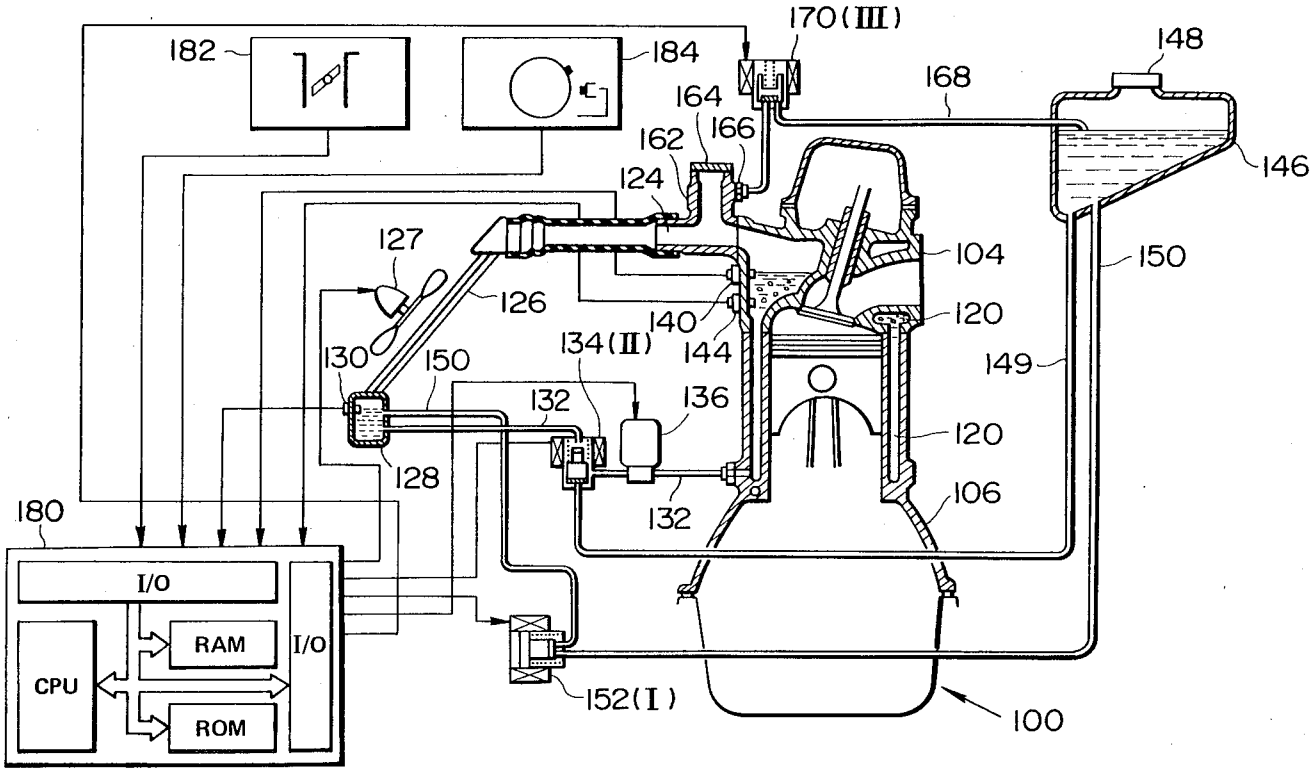
FIG. 7 shows in sectional elevation an engine system according to a first embodiment of the present invention.

FIG. 7 shows an engine system incorporating a first embodiment of the present invention. In this arrangement, an internal combustion engine 100 includes a cylinder block 106 on which a cylinder head 104 is detachably secured. The cylinder head 104 and cylinder block 106 include suitable cavities which define a coolant jacket 120 about the heated portions of the cylinder head and block.

Fluidly communicating with a vapor discharge port 124 of the cylinder head 104 is a radiator or heat exchanger 126. It should be noted that the interior of this radiator 126 is maintained essentially empty of liquid coolant during normal engine operation so as to maximize the surface area available for condensing coolant vapor (via heat exchange with the ambient atmosphere) and that the cooling system as a whole (viz., the system encompassed by the coolant jacket, radiator and conduiting interconnecting same) is hermetically closed when the engine is warmed-up and running. These features will become clearer as the description proceeds.

If deemed advantageous a mesh screen or like separator (not shown) can be disposed in the vapor discharge port 124 of the cylinder head so as to minimize the transfer of liquid coolant which tends to froth during boiling, to the radiator 126.

Located suitably adjacent the radiator 126 is a electrically driven fan 127. Defined at the bottom of the radiator 126 is a small collection reservoir or lower tank 128 as it will be referred to hereinafter. Disposed in the lower tank 128 is a level sensor 130 which is adapted to output a signal indicative of the level of liquid coolant in the lower tank 128 being above a level selected to be lower than the lower ends of the tubing which constitute the radiator per se.

Leading from the lower tank 128 to the cylinder block 120 is a return conduit 132. As shown, a "three-way" type electromagnetic valve 134 and a relatively small capacity return pump 136 are disposed in the conduit 132. The valve 134 is located upstream of the pump 136. The return conduit 132 is arranged to communicate with the lowermost portion of the coolant jacket 120.

In order to sense the level of coolant in the coolant jacket and appropriately control the operation of the pump 136, a level sensor 140 is disposed as shown. It will be noted that this sensor is arranged at a level higher than that of the combustion chambers, exhaust ports and valves (structure subject to high heat flux) so as to enable same to be securely immersed in coolant and thus attenuate any engine knocking and the like which might otherwise occur due to the formation of localized zones of abnormally high temperature or "hot spots".

Located below the level sensor 140 so as to be immersed in the liquid coolant is a temperature sensor 144.

A coolant reservoir 146 is located beside the engine proper as shown. An air permeable cap 148 is used to close the reservoir 146 in a manner that atmospheric pressure continuously prevails therein.

The reservoir 146 fluidly communicates with the "three-way" valve 134 via a supply conduit 149 and with the engine coolant jacket 120 via a displacement or discharge conduit 150 and an ON/OFF type electromagnetic valve 152. This valve is closed when energized. As shown, the conduit 150 communicates with the lower tank 128 at a location essentially level with the second level sensor 130. The cylinder head 104 includes a riser-like portion 162 in which a "purge" port 166 is formed. A cap 164 hermetically closes the riser 162. Port 166, as shown, communicates with the reservoir 164 via an overflow conduit 168. A normally closed electromagnetic valve 170 is disposed in the overflow conduit 168. This valve is opened when energized.

The above mentioned level sensors 130 and 140 may be of any suitable type such as float/reed switch types.

As shown, the outputs of the level sensors 130 and 140 and temperature sensor 144 are fed to a control circuit 180. In this embodiment the control circuit 180 includes therein a microprocessor including input and output interfaces I/O a CPU, a RAM and a ROM. Suitable control programs are set in the ROM and are used to control the operation of the valves 134, 152 and 170, pump 136 and fan 127 in response to the various data supplied thereto.

In order that the temperature of the coolant be appropriately controlled in response to changes in engine load and speed, a load sensor 182 and an engine speed sensor 184 are arranged to supply data signals to control circuit 180. The load sensor may take the form of a throttle position switch which is tiggered upon the engine throttle valve being opened beyond a predetermined degree; alternatively the output of an air flow meter of an induction vacuum sensor may be used. The engine speed signal may be derived from the engine distributor, a crankshaft rotational speed sensor or the like.

Prior to initial use the cooling system is completely filled with coolant (for example water or a mixture of water and antifreeze or the like) and the cap 164 securely set in place to seal the system. A suitable quantity of additional coolant is also poured into the reservoir 146. Although at this time by using de-aerated water when initially filling the system and reservoir, the system is essentially free of contaminating air etc., over a period of time non-condensible matter will find its way into the system. For, example the water (coolant) in the reservoir will tend to absorb atmospheric air and each time the system is filled with coolant (explanation given in detail later) a little non-condensible matter will tend to find its way into the system. Further, during given modes of engine operation, slightly negative pressures develop and although the system is operating in a sealed or closed mode at the time, air, little by little, tends to leak into the system via the gasketing and the like defined between the cylinder head and cylinder block and between the seals defined between conduiting and associated elements of the system.

Accordingly, upon start-up of the engine, given that the engine temperature is blow a predetermined value (45° C. for example) a non-condensible matter purge operation is carried out. In this embodiment the purge operation is effected by pumping coolant into the system for a predetermined period of time. As the system should be essentially full of coolant at this time, the excess coolant thus introduced positively displaces any air or the like the might have collected.

Figure 8:
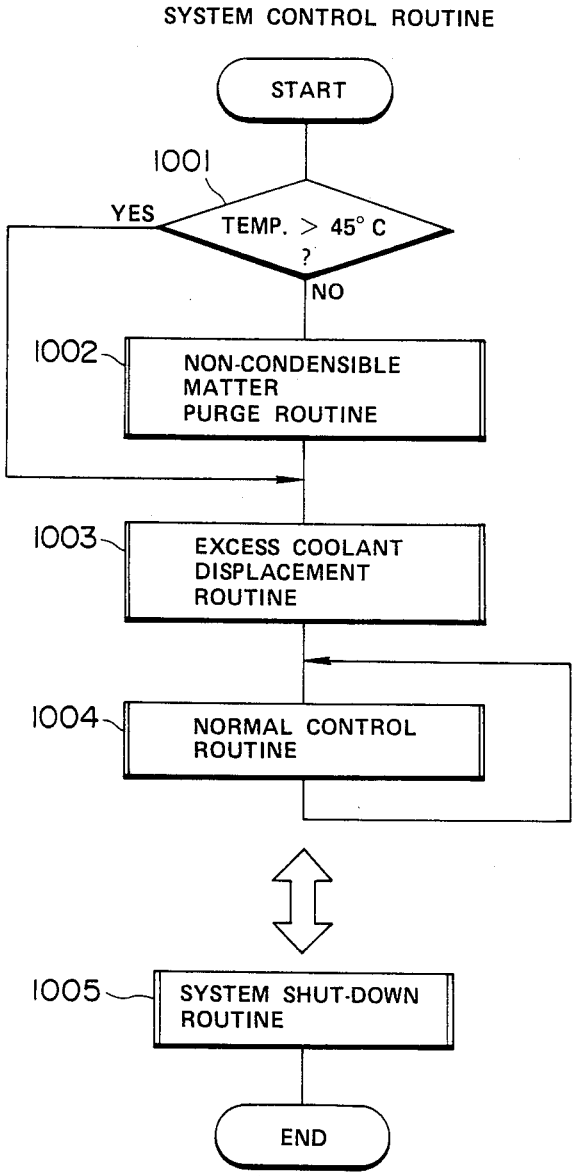
FIGS. 8–14 are flow charts showing the steps which characterize the control of the first embodiment.
Figure 9:
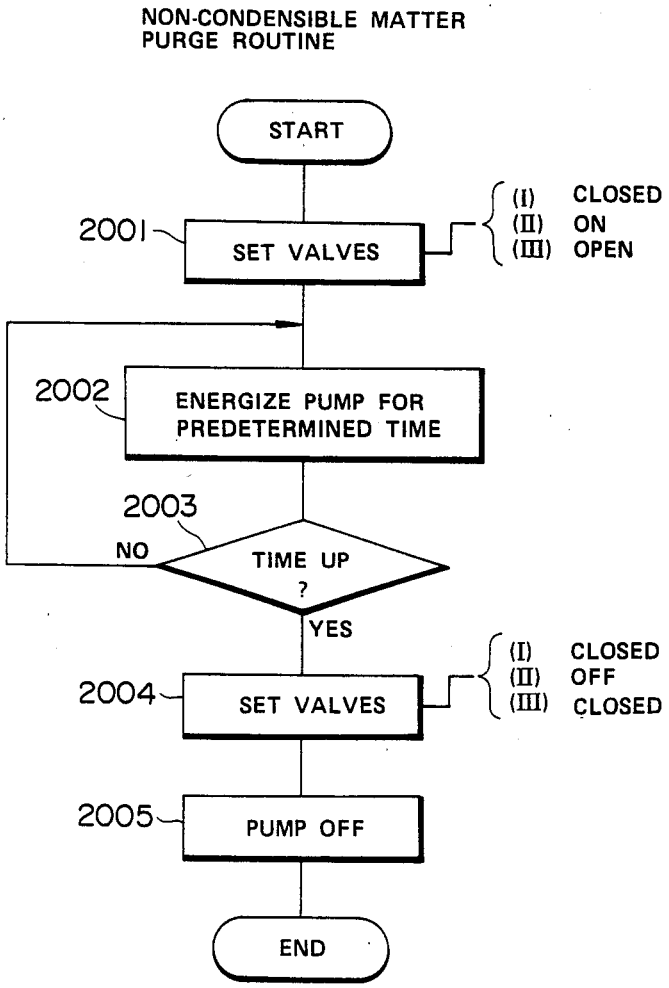

FIG. 8 shows the characterizing steps executed by the microprocessor (control circuit 180) during what shall be termed a "system control routine". As shown, subsequent to the start of this program, it is determined in step 1001 whether the temperature of the engine coolant is greater than 45° C. If the outcome of this enquiry shows that the coolant is still "cold" (viz., below 45° C.) then the program proceeds to step 1002 wherein a "non-condensible matter purge routine" is effected. If the temperature of the coolant is above 45° C., then the coolant is deemed to be "hot" and the program by-passes the purge routine and effects what shall be termed a "hot start". In the event that the purge routine is carried out, the system is considered as undergoing a "cold start".

At step 1003, the program enters an "excess coolant displacement routine" wherein the coolant which fills the radiator and coolant jacket is displaced under the influence of the pressure which develops within the system as the coolant temperature rises. Upon the excess coolant being displaced from the system to the reservoir 146, the program goes on to enter a normal "control routine" (step 1004).

Upon the engine being stopped a "shut-down control routine" is executed (step 1005).

Each of the above mentioned routines will now be set forth in more detail.

NON-CONDENSIBLE MATTER PURGE ROUTINE

Upon the control program entering this routine, the electromagnetic valves are set as shown. Viz., the normally open valve 152 (I) is energized so as to assume a closed state, three-way valve 134 (II) is energized (ON) so that the valve member moves against the bias of the spring associated therewith to establish fluid communication between the pump 136 and the reservoir 146 via conduit 149, and valve 170 (III) is energized so as assume an open state and establish communication between the riser 162 and the reservoir 146 via conduit 168. Subsequently, pump 136 is energized for a predetermined period of time. This period can be as long at 1 minute or more, however for practical purposes several to several tens of seconds is sufficient under normal circumstances to ensure that all of the air and the like is forced out of the system.

At step 2003 an enquiry is executed to determine if the the preselected time has elasped or not. In the event the time has not elapsed the routine recycles. Upon the expiry of said predetermined period the electromagnetic valves are set as shown. Viz., valve 152 (I) is maintained closed via continued energization, valve 135 (II) is de-energized (OFF) to permit the valve element thereof to assume a position wherein communication is established between the radiator 126 and pump 136, and valve 170 (III) is de-energized so as to cut off communication between the purge port 166 and the reservoir 126. This places the system in readiness for the next control routine, viz., the excess coolant displacement routine. At step 2005 the operation of the pump 136 is terminated and the routine ends.

EXCESS COOLANT DISPLACEMENT ROUTINE

Figure 10A:
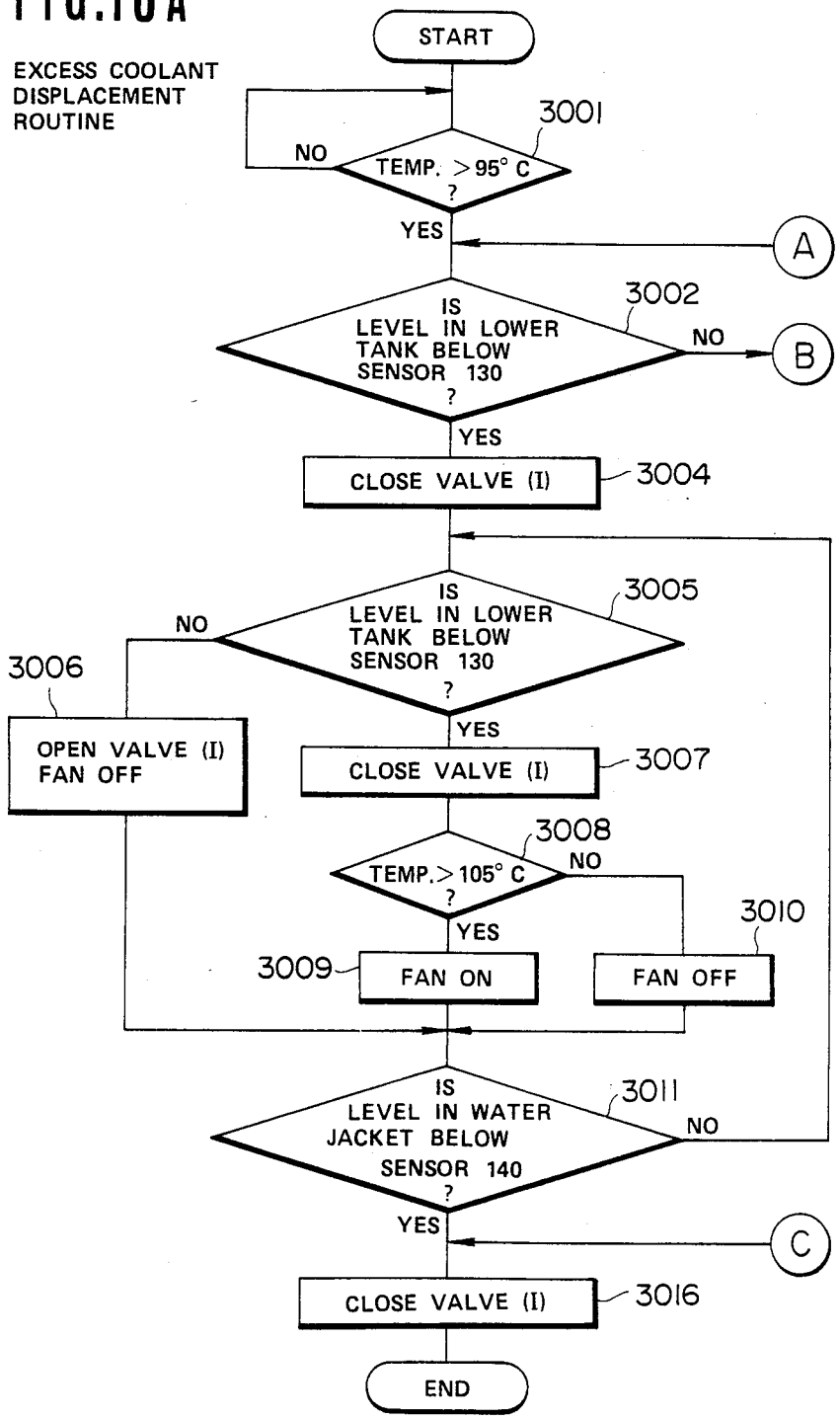

As shown in FIG. 10A, subsequent to the start of this routine, an enquiry is conducted to determine if the temperature of the engine coolant is above 95° C. or not (step 3001). In the event that the temperature has not yet reached this value the routine recycles. As will be appreciated, until at temperature of the nature just mentioned is reached, a vapour pressure of a magnitude sufficient for displacing coolant from the radiator 126 and the coolant jacket 120 of the system will not be generated and thus further operations should be held until this state is aquired.

Figure 10B:
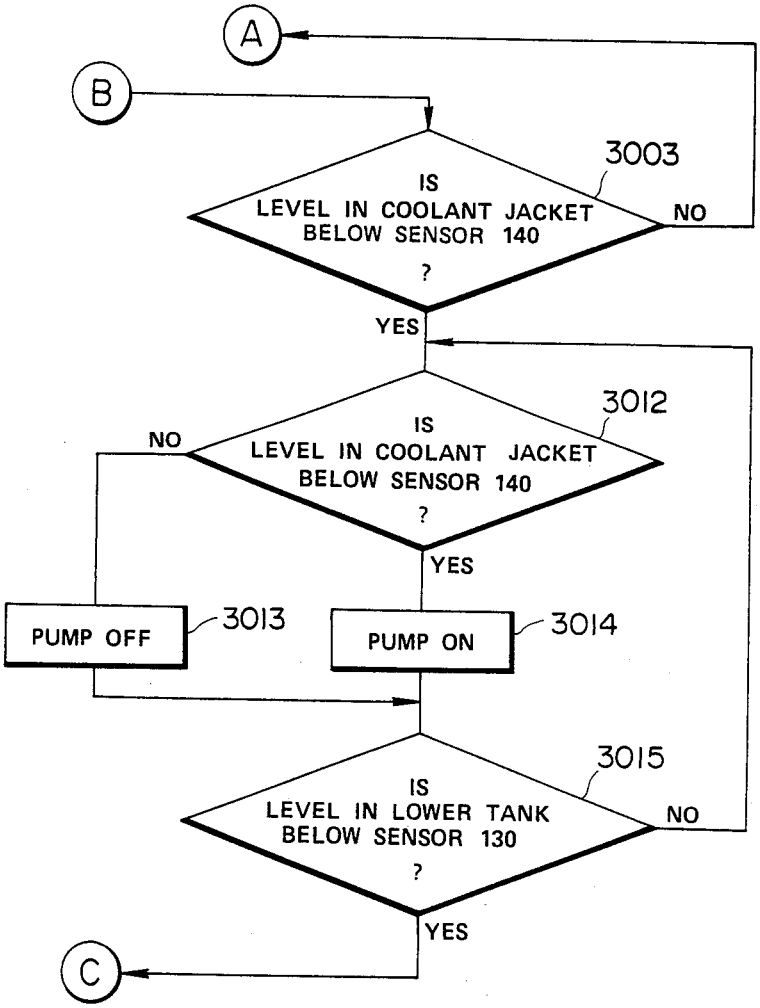

At step 3002 it is determined if the level of coolant in the lower tank 128 is below level sensor 130. If the level is still above this sensor, sufficient coolant has not yet been displaced from the radiator 126 and the routine proceeds to step 3003 (see FIG. 10B). In this step it is determined if the level of coolant in the coolant jacket is below level sensor 140. In the event that the level of coolant in the coolant jacket is still above level sensor 140, excess coolant is determined to be still present in the system and the routine recycles to step 3002.

If the outcome of the enquiry conducted at step 3002 indicates that the level of coolant in the lower tank 128 is below sensor 130 then the routine proceeds to step 3004 wherein valve 152 is closed.

At step 3005 it is again determined if the level of coolant in the lower tank 128 is below level sensor 130. If the outcome of this enquiry indicates that the level is as yet still above said sensor than the routine proceeds to step 3006 wherein valve 152 (I) is opened and the operation of the fan prevented. On the other hand, if the level in the lower tank has dropped to that of the sensor 130 (or lower) then the routine proceeds to step 3007 wherein valve 152 (I) is closed.

At step 3008 it is determined if the temperature of the coolant is greater than 105° C. If the temperature has reached or exceeded this valve fan 127 is energized (step 3009). On the other hand should the temperature still be below 105° C. then the fan is prevented from operating (step 3010).

At step 3011 it is determined if the level of the coolant in the coolant jacket 120 is below sensor 140. If the outcome of this determination indicates that the level is above sensor 140 then the routine recycles to step 3005.

If the outcome of the enquiry performed at step 3003 indicates that the level of coolant in the coolant jacket 120 is in fact below sensor 140 then the routine (see FIG. 10B) goes to step 3012 wherein the enquiry is repeated. If the outcome of the second determination indicates that the level is not below sensor 140 the operation of pump 136 is stopped (step 3013) while in the event that the level has fallen below sensor the pump 136 is energized (step 3014) so to bring the level of coolant back up to the required level above the combustion chambers and associated highly heated structure.

At step 3015 it is determined if the level of coolant in the lower tank 128 is below sensor 130. If not, the routine recycles to step 3012, while if the answer to the 3015 enquiry is positive then the routine goes to step 3016 (see FIG. 10A) whereat valve 152 is closed and the routine terminates.

Thus, as will be appreciated from the above, as the pressure within the system rises and the coolant is displaced out through valve 152 and conduit 150 to the reservoir 146, upon the level of coolant dropping that that at which the level sensor 140 in the coolant jacket is uncovered, pump 136 is energized and the coolant from the radiator pumped into the coolant jacket 120. This proceedure tends to maintain the level of coolant in the coolant jacket 120 at that of level sensor 140 while draining the radiator 126. Upon the level of coolant in lower tank 128 having fallen below sensor 130 the situation wherein the excess coolant has been displace and that required predetermined amount of coolant for normal operation is contained within the system.

NORMAL OPERATION CONTROL ROUTINE

Figure 11:
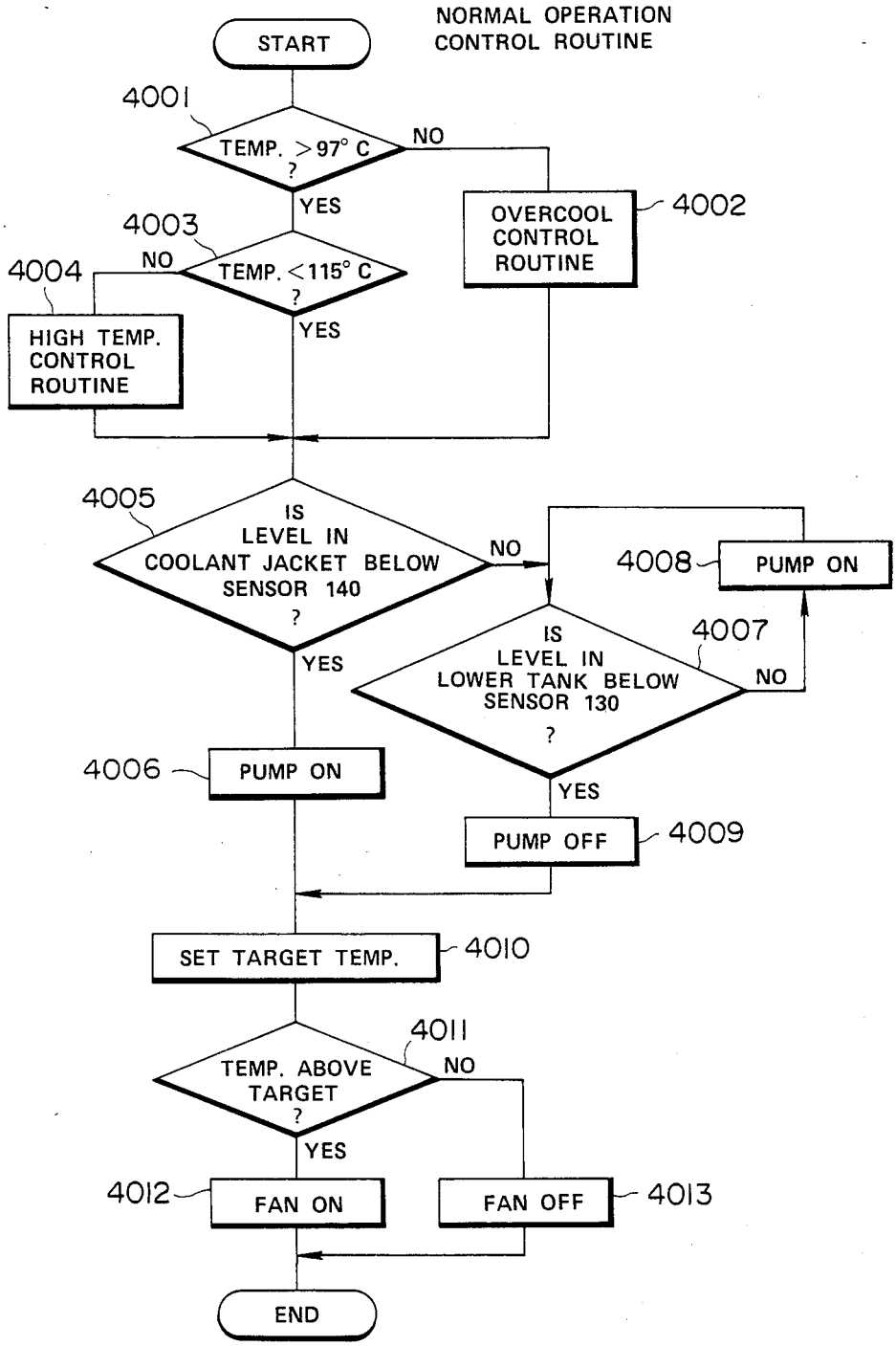
Figure 12:
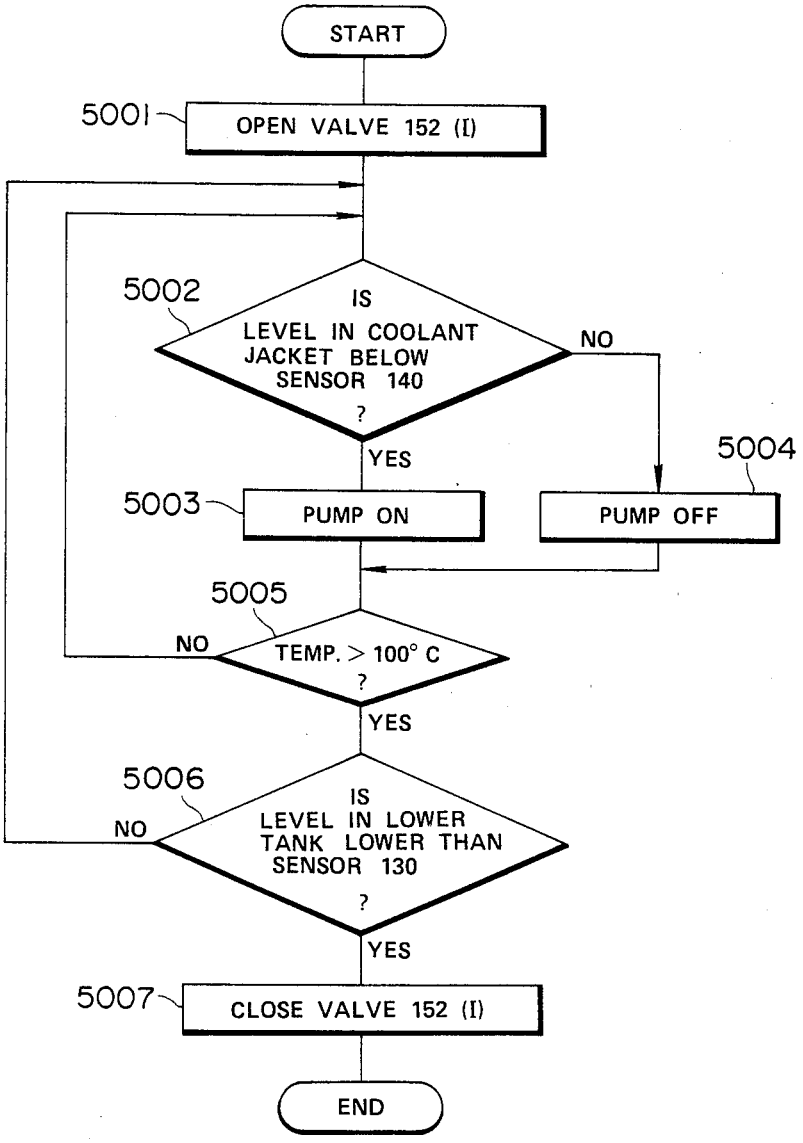

FIG. 11 shows the proceedure followed during normal control. At step 4001 of the flow chart which illustrates the steps which characterize this control, it is determined if the temperature of the coolant is greater than a predetermined minimum level. In this embodiment the minimum level is set at 97° C. If the coolant temperature is sensed as being below the minumum permissible level, an "overcool control routine is initiated in step 4002. On the other hand, should the temperature of the coolant be sensed as being above 97° C. then the enquiry is made to determine if the temperature of the coolant is above a predetermined maximum permissible level. In this embodiment the maximum level is set at 115° C. If the temperature is above this upper limit then then a "high temperature routine" is carried out. These two routines will be discussed in detail hereinlater.

At step 4004, it is determined if the level of coolant in the coolant jacket 120 is below sensor 140. If the outcome of this determination indicates that the level is below sensor 140 the pump 136 is energized to bring the level back up to that required (step 4005). However, if the level is not lower than sensor 140 then at step 4006 the level of coolant in the lower tank 128 is ascertained. If the level is level of coolant is not below that of sensor 130 then the pump is energized (step 4007). This of course ensures that the interior of the radiator remains dry and thus maximizes the heat exchange surface area thereof. However, if the lever is in fact below sensor 130 the operation of the pump is terminated (step 4008).

Figure 1:
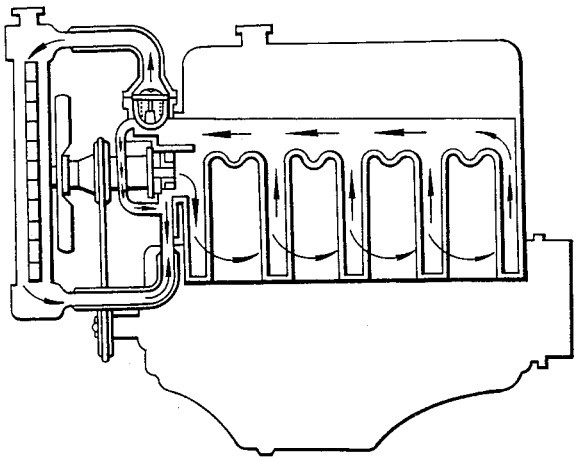
FIG.1 (PRIOR ART)
FIG. 1 is partially sectioned elevation showing a currently used conventional water circulation type system discussed in the opening paragraphs of the instant disclosure.
Figure 2:
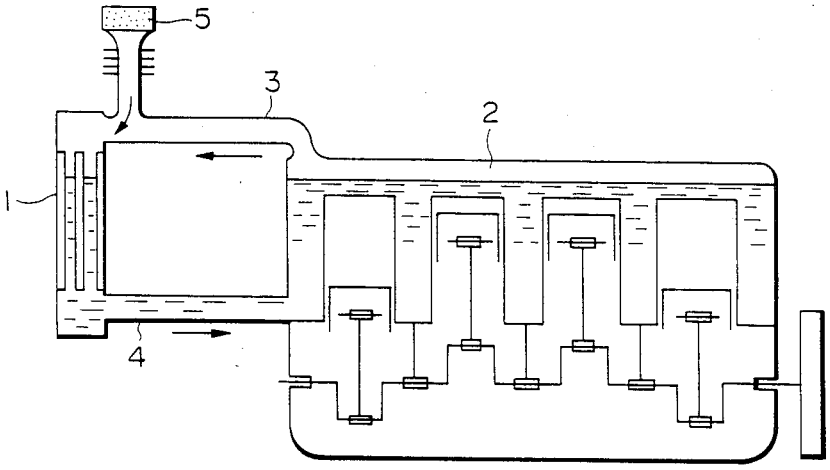
FIG.2 (PRIOR ART)
FIG. 2 is a schematic side sectional elevation of an prior art arrangement also discussed briefly in the earlier part of the specification.
Figure 3:
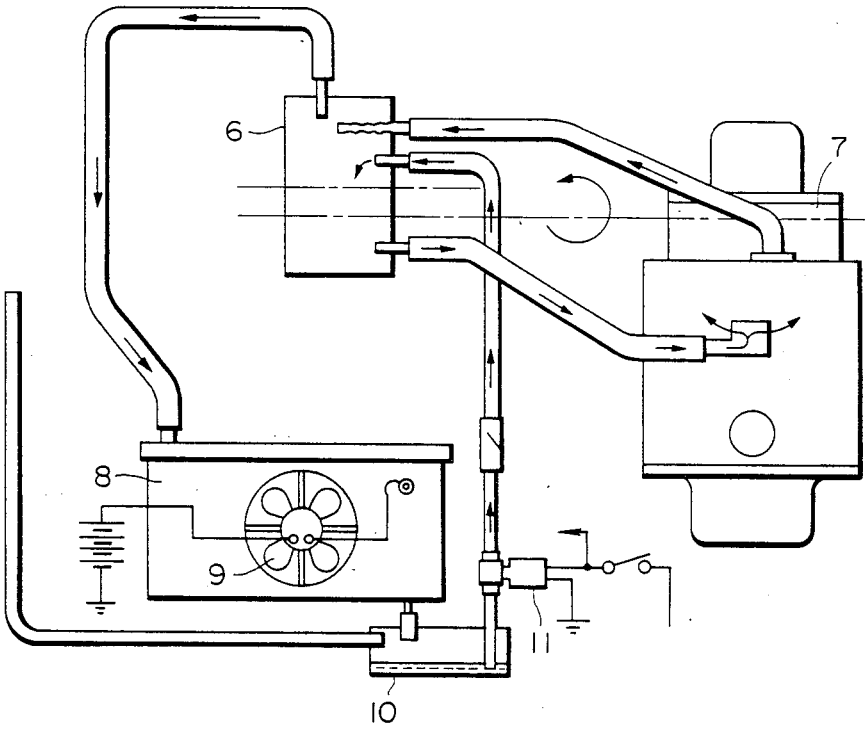
FIG. 3 (PRIOR ART)
FIG. 3 shows in schematic layout form, another of the prior art arrangements previously discussed.
Figure 4:
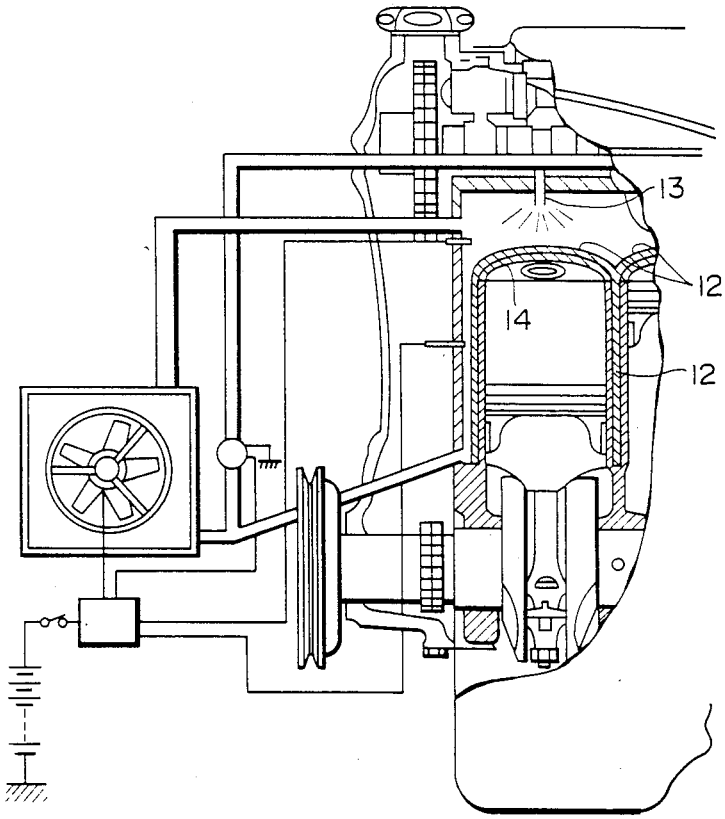
FIG.4 (PRIOR ART)
FIG. 4 shows in partial section yet another of the previously discussed prior art arrangements.
Figure 5:
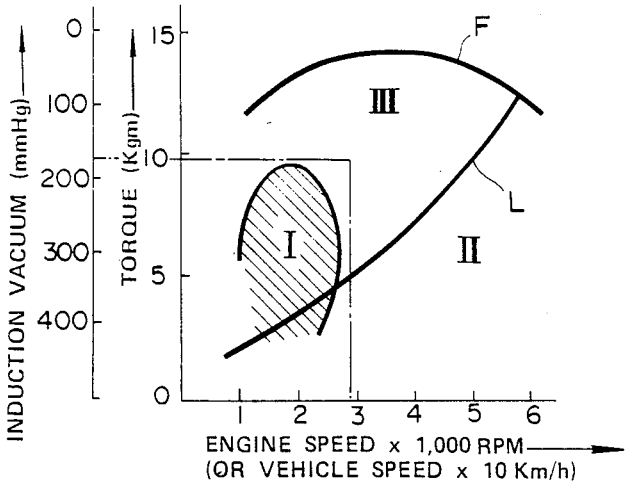
FIG. 5 is a graph showing in terms of engine torque and engine/vehicle speed the various load zones encountered by an automative vehicle.

At step 4009 the "target temperature", viz., the temperature which is best suited to the given mode of the engine operation, is determined. This determination is based on the data inputted from sensors 182 and 184. This determination can be facilitated by storing a table such as that shown in FIG. 5 of the drawings in the ROM of the microprocessor (control circuit 180) and performing a table look-up in oder to ascertain the temperature which best suits the instant load/engine speed conditions.

At steps 4010 to 4012 control of the temperture determined in step 4009 is executed.

OVERCOOL CONTROL ROUTINE

In the event that at step 4001 it is determined that the temperature of the coolant has fallen below the lower permissible limit, at step 5001, valve 152 (I) is opened. As a negative pressure will prevail within the system under such temperature conditions, coolant from the reservoir will be inducted into the system under the influence of atmospheric pressure (and gravity in the illlustrated embodiment). As displacement conduit 150 communicates with the lower tank 128 at a level essentially the same as that of level sensor 130, the coolant forced into the system by the external atmospheric pressure will flow up into into the radiator 126 until the pressure differential which induces the flow is negated. This partially fills the radiator reducing the surface area via which the gasesous coolant may release its latent heat of vaporization to the ambient atmosphere. Accordingly the amount of heat which can be removed from the system is reduced thus obviating an possibility of engine components being crushed by an excessively large pressure differential. This situation will continue until the uncontrollable external influences which induced the overcooling disappear and the coolant temperature can rise back up to 100° C. In the meantime it is necessary that the level of coolant in the coolant jacket 120 is maintained essentially at the level of level sensor 140. Accordingly, at steps 5002, 5003 and 5004, the just mentioned level control is executed.

At step 5005 it is determined if the temperature of the coolant has risen back up to 100° C. If the answer is no, then the routine recycles to step 5002. Upon the coolant temperature increasing to 100° C., indicating that the pressure within the system is equal to atmospheric, the routine proceeds to step 5006 wherein the level of coolant in the lower tank is ascertained. If the level in this vessel is still above the sensor 130, excess coolant is still contained in the system and the routine recycles. Upon the level of coolant reaching and falling just below sensor 130, valve 152 is re-energized (step 5007) so as to close and thus place the system in a "closed" state again.

HIGH TEMPERATURE CONTROL ROUTINE

In the event that, despite the normal non-condensible matter purge procedure carried out when starting the engine, some air is still trapped in the relatively small diameter tubes which define the heat exchanging section of the radiator 126, irrespective of attempts to reduce the pressure in the engine system via fan energization, due to the loss of heat exchange efficiency, the pressure and therefore the temperature of the coolant will tend to rise uncontrollably. This of course tends to induce overheating of the engine. Accordingly, the present invention provides for a second purge function. This is executed by venting the relatively high pressure coolant vapor from the bottom of the radiator via opening valve 152 (I). The opening of this valve permits the vapor in the cylinder head and upper region of the radiator which is at super atmospheric pressure, to flow down through the conduits of the radiator to conduit 150. This flow scavenges out the pockets of air which block the radiator and simultaneously reduces the pressure prevailing within the system to an atmospheric level. The boiling point of the coolant is thus lowered obviating any overheating problems while removing the air or like non-condensible matter which induced the excessively high temperatures. Should the temperature and pressure again rise, a similar scavenging process will be repeated until all of the air is removed.

With the arrangement of the instant embodiment as the coolant vapor is discharged via conduit 150 into the reservoir 146, the cool coolant retained therein provides a "steam trap" effect which tends to condense the gaseous coolant and thus prevent excessive loss of same while permitting the air or the like to be vented to the atmosphere via cap 148.

Figure 13:
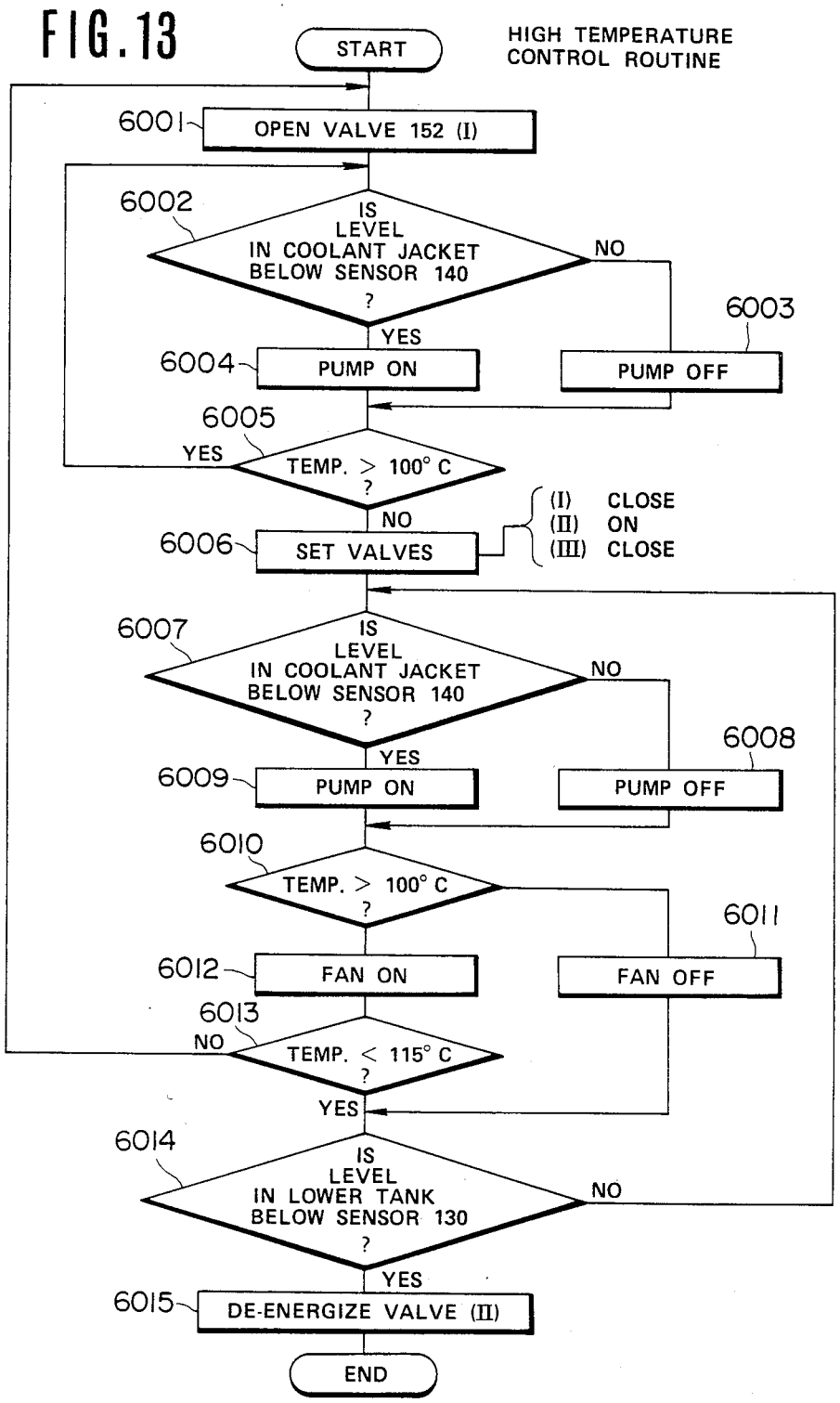
Figure 14:
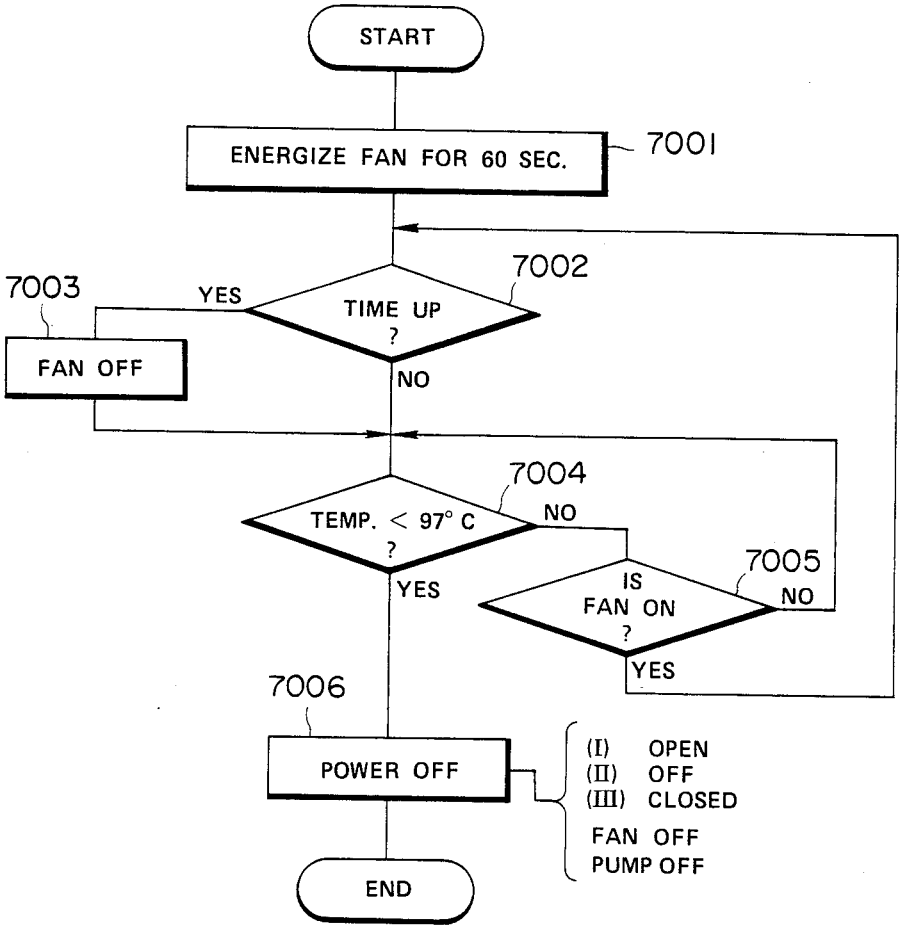

The steps via which the above process is executed are set forth in flow chart of FIG. 13.

As shown at step 6001 valve 152 (I) is opened. Subsequently, at step 6002 the enquiry is made as to whether the level of the coolant in the coolant jacket is below level sensor 140. In the event that sufficient coolant is contained in the coolant jacket 120 the routine proceeds to step 6003 wherein the operation of the pump 136 is terminated. However, in the event that the coolant jacket contains insufficient coolant the pump is energized (step 6004).

At step 6005 it is determined if the temperature is greater than 100° C. If the outcome of this enquiry indicates that the temperature is still above 100° C. then the routine recycles to step 6003. However, if the outcome of the enquiry indicates that the coolant temperature has fallen to above mentioned level, the routine proceeds to step 6006 wherein valve 152 (I) is energized closing same, valve 134 (II) is energized (ON) so as to establish fluid communication between the reservoir 146 and the coolant jacket 120, while valve 170 (III) remains de-energized and closed. The system is now conditioned to replace any of the coolant which was displaced during the "high pressure" purging.

At step 6007 it is determined if the level of coolant in the coolant jacket 120 is below sensor 140. If the appropriate level is sensed the routine proceeds to step 6008, while in the event that insufficient coolant is sensed the routine goes to step 6009. In step 6010 it is ascertained if the temperature of the coolant is greater than 100° C. If the temperature of the coolant is not in excess of this level the routine proceeds to step 1011 wherein the operation of fan 136 is terminated, while if above this limit, the routine goes to step 1012 wherein the fan is energized. At step 1013, it is determined if the temperature of the coolant is above the upper permissible limit (115° C.). If the outcome of this determination is positive, then the routine recycles to step 6001. However, in the event of a negative result, the routine proceeds to step 1014 wherein it is ascertained if the level of coolant in the lower tank 128 is below sensor 130. If the outcome is positive the routine proceeds to step 1015 wherein valve 134 (II) is de-energized establising communication between the radiator and the coolant jacket. However, in the event that the result is negative, the routine recycles to step 6007.

SHUT-DOWN ROUTINE

This routine controls the cooling of the engine temperature and thus the pressure prevailing in the system after the engine is stopped. This prevents an undesirable phenonmenon wherein if the system were to be immediately switched to an open state, the inevitable super atmospheric pressures which prevails due to thermal inertia, causes a large quantity of engine coolant to be forced out of the system via conduit 150 to the reservoir 146. This of course invites loss of coolant and the entry of large amounts of air into the system.

Accordingly, following the opening of the engine ignition switch, this routine proceeds to, in step 7001, energize the fan 127 for a predetermined period of time. In this embodiment the period is selected to be 60 seconds. At step 7002 it is determined if the preselected time has expired. If the time has expired then the fan is stopped (step 7003). On the other hand, if the 60 second period has not as yet expired, the routine proceeds to step 7004. In this step it is determined if the coolant temperature is less than 97° C. If not, the routine goes to step 7005 wherein it is ascertained if the fan 127 is still operating. If the outcome of this enquiry is affirmative then the routine recycles to step 7002. If the answer is negative then the routine returns to step 7004.

Upon the temperature falling to the above mentioned temperature, the supply of power to the entire system is terminated. This results in the situation wherein valve 152 (I) is open, valve 134 (II) is de-energized and establishes communication between the radiator 126 and coolant jacket 120, valve 170 (III) is closed, and the fan and pump are both off. Under these conditions, the negative pressure within the system will induct coolant from the reservoir 146 into the coolant jacket and radiator until the pressure differential between the atmosphere and the interior of the cooling system is reduced to zero. This essentially fills the system with coolant and eliminates any negative pressure might induct contaminating air into the system.

Figure 15:
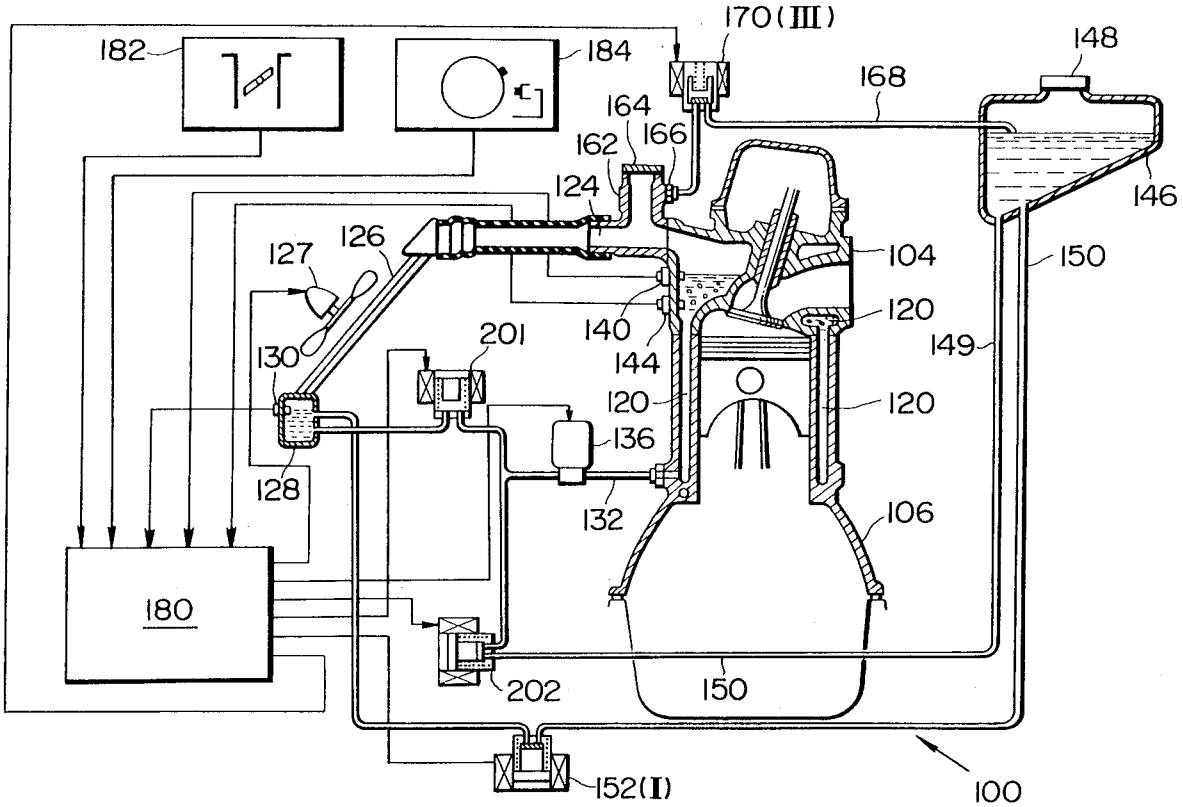
FIG. 15 is sectional elevation similar to that shown in FIG. 7 showing a second embodiment of the present invention.

FIG. 15 shows a second embodiment of the present invention. This embodiment differs from the first one in that the three-way valve 134 shown in FIG. 7 is replaced with two ON/OFF type solenoid valve 201 and 202. The function and operation of these two valves will be obvious in view of the previous disclosure and thus a detailed description of the construction and operation of this embodiment will be omitted for brevity.

What is claimed is:

1. A cooling system for an internal combustion engine comprising:

a coolant jacket formed about structure of said engine subject to high heat flux, said coolant jacket being arranged to receive coolant in liquid form and discharge same in gaseous form;

a radiator;

a first conduit leading from said radiator for introducing liquid coolant from said radiator into said coolant jacket;

a second conduit leading from said coolant jacket to said radiator through which gaseous coolant is transferred from said coolant jacket to said radiator for condensation therein;

a coolant reservoir;

a sensor responsive to one of the temperature and pressure within said coolant jacket;

a third conduit leading from said radiator to said reservoir, said third conduit being arranged to communicate with said reservoir in a manner to define a vapor trap;

a valve arrangement which controls said third conduit; and first means responsive to said sensor for operating said valve arrangement in a manner to open said third conduit when said sensor indicates an overheat condition of said system and permit gaseous coolant to vent through said third conduit to said reservoir, said gaseous coolant being released into said reservoir in a manner to bubble through liquid coolant stored therein.

2. A cooling system as claimed in claim 1, further comprising:

a device for controlling the rate of condensation of the gaseous coolant fed to said radiator from said coolant jacket, into its gaseous form; and second means for controlling said device in a manner to control the pressure prevailing in said coolant jacket and therefore the temperature at which said coolant boils in said coolant jacket.

3. A cooling system as claimed in claim 2, further comprising:

third means for controlling said valve arrangement in a manner that when said engine is stopped, said coolant jacket and said reservoir are placed in fluid communication after said device has been operated in a manner to reduce the pressure prevailing in said coolant jacket toward a level equal to or lower than atmospheric pressure.

4. A cooling system as claimed in claim 2, further comprising:

a fourth conduit leading from the top of one of said coolant jacket and radiator to said reservoir, said fourth conduit being controlled by said valve arrangement so as to be normally closed; and fifth means for, when the engine is started and the temperature of the coolant is below a preselected level, setting said valve arrangement so as to establish fluid communication between said reservoir and said coolant jacket, open said normally closed fourth conduit and energize said pump for a predetermined time so as to pump excess coolant into said coolant jacket through said first conduit, said excess coolant overflowing through said fourth conduit back to said reservoir in a manner to displace any non-condensible matter out of said coolant jacket and radiator.

5. A cooling system as claimed in claim 2, further comprising sixth means for, in the event that the boiling point of the coolant falls below a minimum permissible limit, operating said valve arrangement to permit coolant from said reservoir to be inducted into said radiator so as to partially fill same and reduce the surface area of the radiator via which the coolant vapor can release its latent heat of vaporization to the ambient atmosphere.

6. A cooling system as claimed in claim 1, further comprising:

a pump disposed in said first conduit; and fourth means for operating said pump in a manner to maintain a first predetermined level of coolant in said coolant jacket, said first predetermined level being selected so as to be higher than said structure subject to high heat flux.

* * * * *